US005800140A

United States Patent [19]

Forni

[11] Patent Number: 5,800,140

[45] Date of Patent: Sep. 1, 1998

[54] COMPACT SCROLL FLUID DEVICE

[75] Inventor: Ronald J. Forni, Littleton, Mass.

[73] Assignee: Arthur D. Little, Inc., Cambridge, Mass.

[21] Appl. No.: 736,868

[22] Filed: Oct. 25, 1996

Related U.S. Application Data

[60] Provisional application No. 60/000,961 Jul. 7, 1995.

[51] Int. Cl.[6] ..... F01C 1/04

[52] U.S. Cl. ..... 418/2; 418/55.2; 418/55.3; 418/56

[58] Field of Search ..... 418/2, 55.2, 55.3, 418/56

[56] References Cited

U.S. PATENT DOCUMENTS

| | | | |
|---|---|---|---|
| 2,475,247 | 7/1949 | Mikulasek | 418/55.3 |
| 2,841,089 | 7/1958 | Jones | 418/55.2 |
| 3,874,827 | 4/1975 | Young | 418/55.5 |
| 3,884,599 | 5/1975 | Young et al. | 418/55.3 |
| 4,286,442 | 9/1981 | Peterson | 464/102 |
| 4,300,875 | 11/1981 | Fischer et al. | 418/56 |
| 4,443,166 | 4/1984 | Ikegawa et al. | 418/55.2 |
| 4,846,640 | 7/1989 | Nishida et al. | 418/94 |
| 4,911,621 | 3/1990 | McCullough et al. | 418/188 |
| 5,066,206 | 11/1991 | Kakuda et al. | 418/55.3 |
| 5,088,906 | 2/1992 | Richardson, Jr. | 418/55.2 |
| 5,129,798 | 7/1992 | Crum et al. | 418/55.4 |
| 5,281,114 | 1/1994 | Bush | 418/55.3 |
| 5,328,341 | 7/1994 | Forni | 418/55.3 |
| 5,435,707 | 7/1995 | Hirano et al. | 418/55.2 |
| 5,536,152 | 7/1996 | Kawahara et al. | 418/55.5 |
| 5,556,269 | 9/1996 | Suzuki et al. | 418/55.2 |

FOREIGN PATENT DOCUMENTS

| | | | |
|---|---|---|---|
| 61-58992 | 3/1986 | Japan | 418/55.2 |
| 61-197782 | 9/1986 | Japan | 418/56 |

*Primary Examiner*—John J. Vrablik
*Attorney, Agent, or Firm*—Arthur D. Little, Inc.

[57] ABSTRACT

A compact scroll fluid device includes a pair of wrap support elements with one of the wrap support elements having an inner axial surface formed with an involute spiral recess and the other of the wrap support elements having an involute spiral wrap member projecting from an inner axial surface thereof. The spiral wrap member is received within the spiral recess while being relatively movable about an orbital path therein. A synchronizer assembly is provided axially between the wrap support elements, radially inwardly of both inlet and outlet zones associated with the scroll fluid device and radially outwardly of an orbit center of the device. The entire scroll fluid device is preferably made of plastic. With this arrangement, an extremely compact and inexpensive device is provided.

16 Claims, 2 Drawing Sheets

32
46
5
48
56
50
118
116
109
58
113
51
103
53
44
52
107
104
36
7
-63-
61

118
116
72
46
69
79
74
81
88
48
7
65
76
83
77
61
90
96
-94-
125
44
53
91
51
86
52

COMPACT SCROLL FLUID DEVICE

BACKGROUND OF THE INVENTION

1. Field of the Invention

The present invention pertains to the art of scroll fluid devices and, more specifically, to a compact scroll fluid device that is particularly designed for use in environments requiring low flow rates and which can be manufactured in a cost effective manner for single use application.

2. Discussion of the Prior Art

The term "scroll fluid device" is applied to an arrangement of meshed involute spiraling wraps wherein at least one of the wraps is caused to orbit along a circular path relative to the other wrap. This orbiting motion develops one or more fluid transport chambers between the wraps that move radially between inlet and outlet zones of the device. The scroll wraps are typically coupled by a synchronizer assembly which prevents relative rotation between the wraps while accommodating the relative orbital movement of the wraps. Such scroll fluid devices can function as pumps, compressors, motors or expanders, depending upon their configuration, the drive system utilized, and the nature of the energy transferred between the scroll wraps and the fluid moving through the device.

A significant advantage in the operation of a scroll fluid device can be achieved by minimizing its overall size for a given fluid flow rate. Obviously, minimizing the size of a scroll fluid device can also reduce associated manufacturing costs. In the past, many significant improvements have been made in this field to achieve an overall size reduction in scroll fluid devices. These improvements have mainly focused on reconfiguring and repositioning the synchronizer assembly to reduce either the radial or axial dimensions of the device. In general, these redesigns tend to either reduce axial dimensions of the scroll devices at the expense of radial dimensions, or vise-versa. Of additional concern is that the synchronizer assembly itself can create a problem with respect to the flow of fluid either entering or exiting the scroll device. For example, if the synchronizer assembly is positioned between the scroll wraps and either of the inlet and outlet zones, fluid flowing through the device will actually be required to pass through the synchronizer assembly which can result in system losses.

In some environments, pumping devices are required that need only produce rather low flow rates but which cannot be reused without being thoroughly cleaned between uses. For example, during a surgical or other medical procedure, various bodily fluids may need to be delivered to and withdrawn from a patient. A pump used for this purpose will obviously be exposed to these fluids. Following the procedure, the pump and other exposed system components will either have to be discarded or, in some way, sanitized prior to a subsequent use. Although the associated pumping rates for these systems are rather low such that the pumps can be made fairly small, the cost associated with manufacturing these pumping devices is still quite high and therefore disposing of such a device following a single use is quite costly. Of course, cleaning and sterilizing such a device for later use can also be costly, as well as time consuming.

Therefore, there exists a need in the art for a scroll fluid device that is compact in nature, efficient to operate and economically advantageous to produce, particularly when used to develop rather low fluid flow rates in a single use application.

SUMMARY OF THE INVENTION

The present invention provides a compact scroll fluid device particularly adapted for use in producing a low volumetric flow rate. The scroll fluid device has minimal axial and radial dimensions and incorporates a synchronizer assembly positioned so as to not adversely affect the flow of fluid through the scroll device. The scroll fluid device can be economically manufactured so as to permit the device to be disposed of following a single use.

In order to accomplish these functions, the scroll fluid device of the invention is preferably, entirely made of plastic and includes a pair of meshed involute spiral wraps that are connected to outer wrap support elements in the form of plates. One of the wraps is defined by a spiral wrap member that projects axially from an inner surface of a respective one of the support plates. The other wrap is actually defined by walls of a spiraling recess formed in the inner surface of the other support plate.

In a preferred embodiment of the invention, the scroll fluid device is used to produce a rather low output flow rate through a suction effect, generally in the range of one milliliter per minute ( 1 ml/min) to sixty milliliters per minute ( 60 ml/min) and with a maximum vacuum pressure in the order of 550 mm Hg. Given this capacity, the axially projecting wrap need only spiral through 360 degrees and the recess defined wrap extends through greater than 360 degrees to accommodate inlet and outlet zones. More specifically, the inlet and outlet zones of the scroll fluid device are formed in the spiraling recess at locations spaced from inner and outer end portions of the axially projecting wrap and these zones have associated ports which extend through the plate in which the recess is formed.

The synchronizer assembly for the scroll fluid device of the invention is located axially between the wrap supporting plates and radially inwardly of each of the spiral wraps, as well as both of the inlet and outlet zones. In the preferred embodiment, the synchronizer assembly is defined by a plurality of circumferentially spaced teeth which are formed on one of the support plates and received within respective grooves formed in the other of the support plates. With this arrangement, the synchronizer assembly is spaced radially inward of the fluid flow path established within the device and therefore does not adversely affect the flow of fluid through the device.

Each of the spiraling recess and the synchronizer grooves have associated depths which permit them to fully accommodate the axially projecting wrap and the synchronizer teeth respectively. Therefore, the scroll fluid device has an overall axial dimension essentially defined by the combined thickness of the supporting plates. Given that the wraps only extend radially inward a limited amount, thereby permitting the synchronizer assembly to be located radially inwardly thereof, the scroll fluid device further has a minimal radial dimension. Given these dimensional qualities, an overall compact scroll fluid device is presented which, when made of plastic, can be economically manufactured for use as a single-use, disposable pump or motor product.

Additional features and advantages of the invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
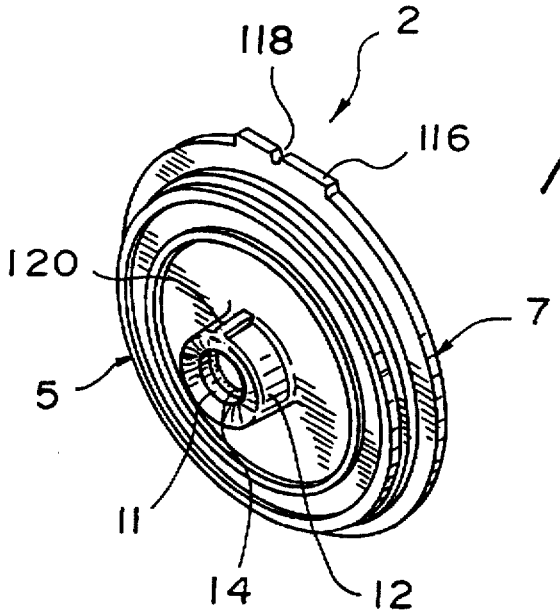
FIG. 1 is a perspective view of a scroll fluid device constructed in accordance with the invention.

With initial reference to FIG. 1, the scroll fluid device constructed in accordance with the present invention is preferably made of plastic and is generally indicated at 2. Scroll fluid device 2 includes a first scroll element 5 and a second scroll element 7. In the preferred embodiment, first scroll element 5 is driven by means of an eccentric driveshaft (not shown) that extends within a bore 11 formed in a central upstanding hub portion 12 of first scroll element 5 and second scroll element 7 is preferably fixed in a desired position. As the manner in which scroll fluid devices are generally driven to enable relative orbital motion between meshed scroll elements is widely known in the art, this operation will not be duplicated here. However, it should be understood that, although second scroll element 7 is fixed against rotation in the preferred embodiment, scroll fluid device 2 could constitute a co-rotating scroll arrangement without departing from the spirit of the invention. For reasons which will be more fully discussed below, an O-ring 14 is adapted to be arranged within bore 11.

Figure 2:
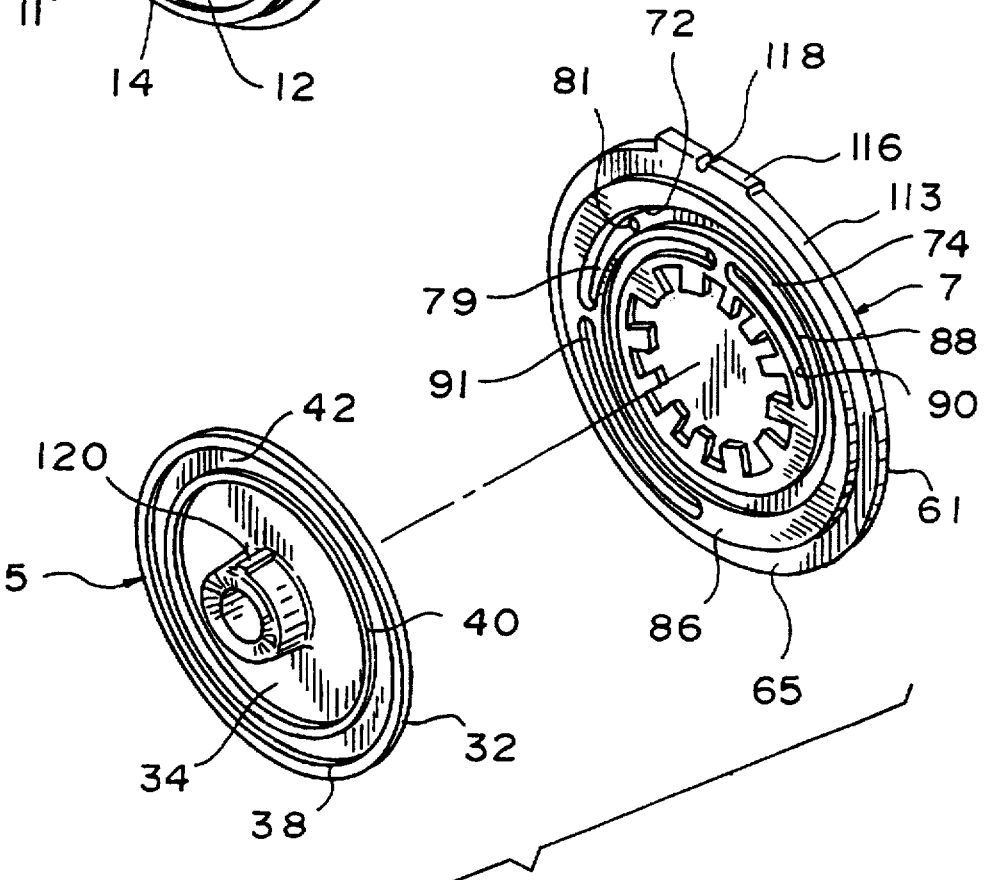
FIG. 2 is an exploded view taken in a first direction of the scroll fluid device of FIG. 1.
Figure 3:
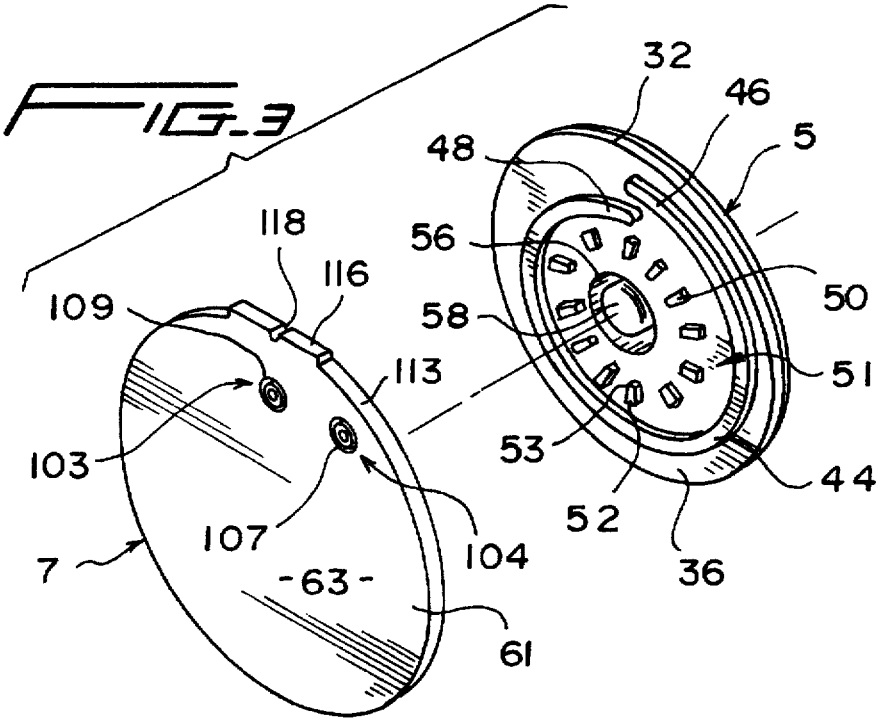
FIG. 3 is an exploded view of the scroll fluid device of FIG. 1 taken in a direction opposite that of FIG. 2.

Reference will now be particularly made to FIGS. 2 and 3 in describing the preferred construction of first and second scroll elements 5 and 7. First scroll element 5 includes a first wrap support element 32 which takes the form of a plate having an outer axial side 34 and an inner axial side 36. Outer axial side 34 is provided with an outer, annular upstanding flange 38 and an inner, annular upstanding flange 40. Between inner and outer upstanding flanges 40 and 38 is defined a recessed area 42 which is adapted to receive a sealing ring (not shown) when scroll fluid device 2 is mounted for use.

Second axial side 36 of first wrap support plate 32 is best shown in FIG. 3 and has projecting therefrom an axially extending involute spiral wrap member 44. Wrap member 44 has a first end portion 46 and a second end portion 48. Located radially inwardly of spiral wrap member 44 is a plurality of circumferentially spaced teeth 50 that form part of a synchronizer assembly 51 of scroll fluid device 2. As shown in both FIGS. 3 and 4, each of the teeth 50 has a radial outer section 52 that is wider than a radial inner section 53 thereof such that each of the teeth 50 taper radially inwardly. Located inwardly of teeth 50 on second axial side 36 is an annular depression zone 56 and a raised central body 58, which collectively define central upstanding hub portion 12.

Figure 4:
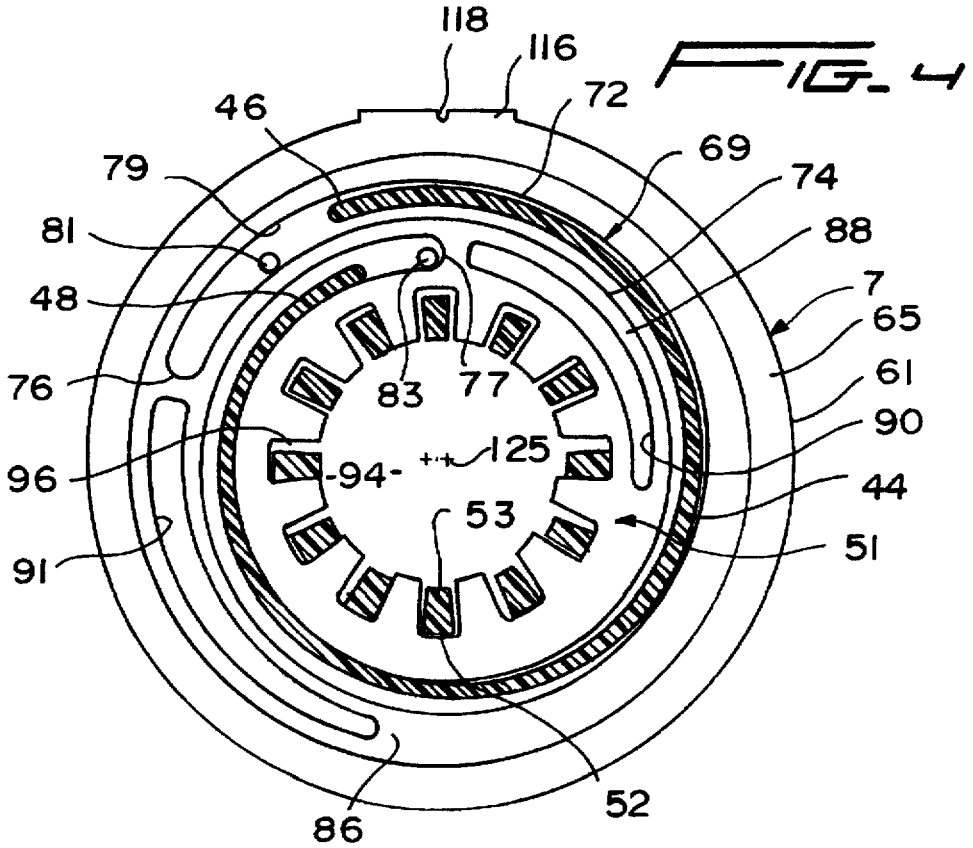
FIG. 4 is a partial, cross-sectional view of the scroll fluid device of FIG. 1.

Second scroll element 7 similarly includes a second wrap support element 61 in the form of a plate having an outer axial side 63 and an inner axial side 65. As best shown in FIGS. 2 and 4, second wrap support plate 61 includes a second spiral wrap member 69 formed by an upstanding outer wall portion 72 and an upstanding inner wall portion 74 which are interconnected by end walls 76 and 77. Upstanding wall portions 72 and 74, as well as end walls 76 and 77, collectively define a spiral recess 79. Spaced from end wall 76, spiral recess 79 is provided with a first port 81 and, adjacent end wall 77, spiral recess 79 is formed with a second port 83. As will be discussed further below, each of ports 81 and 83 can define either inlet or outlet zones depending on the method of operation of scroll fluid device 2.

Due to the spiraling of second wrap member 69, second axial side 65 of second wrap support plate 61 is formed with an outer, radially thickened wall portion 86 and an inner, radially thickened wall portion 88. In order to minimize the amount of material needed to form scroll fluid device 2 and thereby reduce associated manufacturing costs, arcuate recesses 90 and 91 are preferably provided in inner and outer thickened wall portions 88 and 86 respectively. Second axial side 65 is also formed with a central depression area 94 and a plurality of grooved radial projections 96 which constitute another portion of synchronizer assembly 51 as will be discussed more fully below.

First axial side 63 of second wrap support plate 61 is formed with a pair of spaced port connections 103 and 104. Each of port connections 103 and 104 has a central tubular cylinder portion 107 having an annular space 109 thereabout. Each tubular cylinder portion 107 is in fluid communication with a respective port 81 and 83 through second wrap support plate 61. With this construction, flow conduits or passages (not shown) can be readily placed in fluid communication with each tubular cylinder portion 107 of scroll fluid device 2. As clearly shown in these Figures, second wrap support plate 61 includes an outer periphery 113 that is formed with a radially projecting ledge 116 having a central notch 118. This structure is provided in accordance with a preferred embodiment of the invention and constitutes an alignment and mounting aid for second wrap support plate 61 of scroll fluid device 2.

When assembled, axially extending spiral wrap member 44 of first scroll element 5 meshes with second spiral wrap member 69 of second scroll element 7. More specifically, spiral wrap member 44 is received within spiral recess 79 as clearly shown in FIG. 4. To aid in properly positioning spiral wrap member 44 in spiral recess 79, first scroll element 5 is provided with a projection 120 on hub portion 12 which is to be aligned with notch 118. With spiral recess 79 fully accommodating spiral wrap member 44, the overall axial dimension of scroll fluid device 2 is essentially equal to the combined thickness of first and second wrap support plates 32 and 61, i.e., less than 1 cm in the compact embodiment shown, even though walls 72 and 74 are slightly raised from inner axial side 65 as shown in FIG. 2. In addition, this compact scroll fluid device 2 has an outer diameter which is less than approximately 7.5 cm.

In the preferred embodiment wherein second scroll element 7 is fixed, first scroll element 5 is driven to orbit about geometric center 125 relative to second scroll element 7. In this embodiment, drive to first scroll element 5 is carried out by inserting an eccentric driveshaft (not shown) within bore 11 with O-ring 14 being positioned between the driveshaft and central upstanding hub portion 12. With this arrangement, O-ring 14, which can either be mounted in hub portion 12 or carried by the driveshaft, will provide a certain degree of radial compliance for scroll fluid device 2. Through this orbital motion, at least one radially and, even more so, tangentially moving fluid chamber is developed between first and second wrap members 44 and 69. When orbited in a first direction, fluid will be drawn into first port 81 and discharged through second port 83. When orbited in an opposite direction, fluid will be drawn into second port 83, and discharged through first port 81.

As indicated above, the scroll fluid device 2 depicted is specifically designed to operate at a rather low volumetric rate, preferably by creating a vacuum to produce a flow rate in the range of 1 ml/min to 60 ml/min, and at a maximum vacuum pressure of about 550 mm Hg. The limited degree of spiraling of the wrap members 44 and 69 permits synchronizer assembly 51 to be arranged radially inward of ports 81 and 83, but yet sufficiently outward of the geometric center 125 for wrap member 44 to provide operational stability. As the particular operation of synchronizer assembly 51 is widely known in the art, along with the various other potential operating modes for scroll fluid device 2, these aspects of the device will not be further detailed here.

Since scroll fluid device 2, at least in accordance with the preferred embodiment depicted and described herein, is formed of plastic and is extremely compact, scroll fluid device 2 can be manufactured at minimal cost and therefore presents an economically viable, disposable unit that can be used in various fields. In addition, given the presence of external port connections 103 and 104, scroll fluid device 2 can be readily connected and disconnected to an overall fluid flow control system.

Although described with respect to a preferred embodiment of the invention, it should be recognized that various changes and/or modifications may be made to the invention without departing from the spirit thereof. For instance, although an extremely compact scroll fluid device has been shown and described, it should be readily apparent that various features of the invention could advantageously be incorporated in scroll fluid devices having larger capacities but which could themselves be made more compact and economically attractive. In general, the invention is only intended to be limited by the scope of the following claims.

I claim:

1. A compact scroll fluid device comprising:

first and second involute spiral wrap members, each of said first and second wrap members having respective first and second end portions, said first and second wrap members being meshed and defining at least one fluid chamber between them that moves radially from an inlet zone to an outlet zone when one of said first and second wrap members is orbited along a circular path relative to the other of said first and second wrap members;

first and second wrap support elements, each of said first and second wrap support elements supporting a respective one of said first and second wrap members, at least one of said first and second wrap support elements being adapted to be driven to create a relative orbital motion between the first and second wrap members; and a synchronizer assembly interconnecting said wrap support elements and preventing relative rotation between said wrap members while accommodating their relative orbital motion, said synchronizer assembly being arranged axially between said first and second wrap support elements and radially between a central portion of said scroll fluid device and said inlet and outlet zones such that said synchronizer assembly is spaced radially from the central portion.

2. The compact scroll fluid device according to claim 1, wherein one of said first and second wrap members defines by a spiraling recess formed in a respective one of said first and second wrap support elements.

3. The compact scroll fluid device according to claim 2, wherein said inlet and outlet zones are located at radial inner and outer end portions of said spiraling recess.

4. The compact scroll fluid device according to claim 3, wherein each of said inlet and outlet zones includes a respective port that extends through said respective one of said first and second wrap support elements.

5. The compact scroll fluid device according to claim 4, further comprising port connections formed in an outer axial portion of said respective one of said first and second wrap support elements, each of said port connections being in fluid communication with a respective said port.

6. The compact scroll fluid device according to claim 2, further comprising at least one arcuate recess formed in said respective one of said first and second wrap support elements.

7. The compact scroll fluid device according to claim 2, wherein said synchronizer assembly comprises a plurality of annularly spaced teeth attached to an inner axial surface of one of said first and second wrap support elements and a plurality of annular spaced grooves formed in the other of said first and second wrap support elements, each of said plurality of teeth being received, for relative orbital movement, within a respective one of said plurality of grooves.

8. The compact scroll fluid device according to claim 1, wherein said second wrap support element is provided with a position indicator to aid in aligning said second wrap support element for mounting in a fixed position.

9. The compact scroll fluid device according to claim 1, wherein at least one of said wrap members spirals through less than 450 degrees.

10. The compact scroll fluid device according to claim 1, wherein said scroll fluid device is formed of plastic.

11. A compact scroll fluid device comprising:

first and second wrap support elements, each of said first and second wrap support elements including inner and outer surfaces;

an involute spiral wrap extending axially from the inner surface of said first wrap support element;

an involute spiral recess formed in the inner surface of said second wrap support element, said spiral recess receiving said spiral wrap member therein;

radially spaced inlet and outlet ports in fluid communication with said spiral recess;

a synchronizer assembly interconnecting said first and second wrap support members, said synchronizer assembly preventing relative rotation, while accommodating relative orbital movement, between said first and second wrap support members with the relative orbital movement causing a fluid chamber to move radially, within said spiral recess, from a first position in fluid communication with said inlet port to a second position in fluid communication with said outlet port, said synchronizer assembly including a plurality of annularly spaced teeth attached to an inner axial surface of one of said first and second wrap support elements and a plurality of annular spaced grooves formed in the other of said first and second wrap support elements, each of said plurality of teeth being received, for relative orbital movement, within a respective one of said plurality of grooves; and first and second position indicators provided on the first and second wrap support elements respectively to aid in properly positioning said plurality of teeth within respective ones of said plurality of grooves.

12. The compact scroll fluid device according to claim 11, wherein said inlet and outlet ports are located at radially inner and outer end portions of said spiraling recess.

13. The compact scroll fluid device according to claim 11, further comprising at least one arcuate recess formed in the inner surface of said second wrap support element.

14. The compact scroll fluid device according to claim 11, wherein said second position indicator further aids in aligning said second wrap support element for mounting in a fixed position.

15. The compact scroll fluid device according to claim 11, wherein said synchronizer assembly is arranged axially between said first and second wrap support elements and radially inwardly of each of said inlet and outlet ports.

16. The compact scroll fluid device according to claim 11, wherein said scroll fluid device is formed of plastic.

* * * * *